US008752498B1

(12) United States Patent
Schwindaman et al.

(10) Patent No.: US 8,752,498 B1
(45) Date of Patent: Jun. 17, 2014

(54) AUTOMATIC BIMINI TOP

(76) Inventors: Michael A. Schwindaman, Cassopolis, MI (US); Michael Wallace Howard, Elkhart, IN (US)

( * ) Notice: Subject to any disclaimer, the term of this patent is extended or adjusted under 35 U.S.C. 154(b) by 34 days.

(21) Appl. No.: 13/568,015

(22) Filed: Aug. 6, 2012

(51) Int. Cl.
*B63B 17/02* (2006.01)

(52) U.S. Cl.
USPC ..... 114/361; 135/88.01

(58) Field of Classification Search
CPC ..... B63B 17/02; B63B 19/02; B63B 17/00; B63B 17/04; B63B 15/00; B63B 35/731; B63B 25/002; A45B 11/00; A61G 5/10
USPC ..... 114/343, 361, 364; 135/88.01
See application file for complete search history.

(56) References Cited

U.S. PATENT DOCUMENTS 6,209,477 B1 * 4/2001 Biedenweg ..... 114/361
6,983,716 B1 * 1/2006 Ankney et al. ..... 114/361
7,370,597 B1 * 5/2008 Schwindaman ..... 114/361
7,389,737 B1 * 6/2008 Schwindaman ..... 114/361
7,438,015 B1 * 10/2008 Schwindaman ..... 114/361
7,950,342 B2 * 5/2011 Russikoff ..... 114/361

* cited by examiner

*Primary Examiner* — Lars A Olson
(74) *Attorney, Agent, or Firm* — Larry E. Henneman, Jr.; Gregory P. Gibson; Henneman & Associates, PLC

(57) ABSTRACT

An adjustable watercraft awning includes a first base, a second base, a first frame member, a second frame member, an actuator, and a flexible cover. The first base is adapted to mount on a first side of a watercraft, and the second base is adapted to mount on a second side of the watercraft. The first frame member is pivotally coupled to a rear region of each of the first and second bases, and is movable between a lowered position and a raised position. The second frame member is pivotally coupled to a front region of each of the first and second bases, and is continuously movable between a lowered position and a first raised position and also between the first raised position and a second raised position. The actuator is coupled to transmit mechanical power to the second frame member only.

20 Claims, 11 Drawing Sheets

AUTOMATIC BIMINI TOP

BACKGROUND OF THE INVENTION

1. Field of the Invention

This invention relates generally to vehicle awnings, and more particularly to adjustable awnings for watercraft.

2. Description of the Background Art

Watercraft are commonly equipped with adjustable awnings such as, for example, convertible bimini tops. Typically, a convertible bimini top includes a collapsible frame assembly supporting a flexible cover (e.g., canvas). The frame assembly includes a rigid front support structure and a rear support structure coupled to the front and rear, respectively, of the flexible protective cover. Furthermore, the front and rear support structures are typically U-shape wherein each open end is hingably coupled to an opposite side-rail of the watercraft.

In many designs, the bimini top can be arranged into three different positions including a downward folded position, a radar position, and a fully deployed position. In the downward folded position, both the front and rear support structures are folded completely back to a substantially horizontal position such that the frame assembly and protective cover are collapsed near the stern of the watercraft. In the radar position, both support structures are arranged parallel and/or directly adjacent to one another in a fixed, partially raised position. When in arranged in either the downward folded position or the radar position, the tops of the support structures are held together via a boot that wraps around the collapsed cover. In the fully deployed position, the front support structure is positioned upwardly toward the bow of the boat while the rear support is positioned upwardly toward the stern, thus deploying the cover and providing shelter thereunder.

There are disadvantages associated with conventional watercraft awning designs. For example, awnings typically only operate in a limited number of deployed positions and, therefore, do not provide optional user configurations to accommodate for different situations (e.g., location/intensity of the sun, direction/intensity of wind, etc.). As another example, adjustable awnings are not very robust because their frames are typically not very sturdy. As yet another example, many adjustable awning designs (especially automatic devices) require a high number of moving parts thus making them expensive to manufacture and generally less reliable.

What is needed, therefore, is an adjustable awning that can be configured to operate in more positions than prior art awnings. What is also needed is an adjustable awning that is more robust. What is also needed is an adjustable awning that requires fewer parts than adjustable awnings of the prior art.

SUMMARY

The present invention overcomes the problems associated with the prior art by providing an adjustable watercraft awning that can be configured in a variety of deployed positions.

The adjustable watercraft awning includes a first base, a second base, a first frame member, a second frame member, an actuator, and a flexible cover. The first base includes a rear region and a front region, and is adapted to mount on a first side of a watercraft. The second base includes a rear region and a front region, and is adapted to mount on a second side of the watercraft. The first frame member includes a first end, a second end, and an intermediate region. The first end of the first frame member is pivotally coupled to the rear region of the first base, the second end of the first frame member is pivotally coupled to the rear region of the second base, and the first frame member is movable between a lowered position and a raised position. The second frame member includes a first end, a second end, and an intermediate region. The first end of the second frame member is pivotally coupled to the front region of the first base and the second end of the second frame member is pivotally coupled to the front region of the second base. Additionally, the second frame member is movable between a lowered position and a first raised position and is also between the first raised position and a second raised position. The actuator is coupled to transmit mechanical power to the second frame member. The flexible cover includes a rear region coupled to the intermediate region of the first frame member and a front region coupled to the intermediate region of the second frame member. The flexible cover is operative to unfold to a deployed position in response to moving the second frame member from the lowered position to the first raised position. Furthermore, the flexible cover is operative to pull the first frame member from the lowered position to the raised position in response to moving the second frame member from the first raised position to the second raised position.

In an example embodiment, the adjustable awing additionally includes a rotation limiting feature operative to prevent the first frame member from rotating beyond the raised position. For example, the rotation limiting feature includes a first mitered surface formed on the first end of the first frame member and a second mitered surface formed on the second end of the first frame member. The first mitered surface is adapted to abut the first base when the first frame member is in the raised position, and the second mitered surface is adapted to abut the second base when the first frame member is in the raised position. The actuator is operative to exert a force on the second frame member when the second frame member is in the second raised position and the first frame member is in the raised position. The force exerted on the second frame member is sufficient to elastically deflect the second frame member.

In the example embodiment, the first frame member defines a first side region and an opposite second side region. The first end of the first frame member is formed on the first side region of the first frame member and the second end of the first frame member is formed on the second side region of the first frame member. The adjustable watercraft awning additionally includes a third frame member that has a first end, a second end, and an intermediate region. The first end of the third frame member is pivotally coupled to the first side region of the first frame member between the first end of the first frame member and the intermediate region of the first frame member. The second end of the third frame member is pivotally coupled to the second side region of the first frame member between the second end of the first frame member and the intermediate region of the first frame member. The intermediate region of the third frame member is couple to the intermediate region of the flexible cover. In an even more particular embodiment, the third frame member is disposed to move toward the intermediate region of the first frame member as the second frame member is moved from the first raised position to the down position. In yet an even more particular embodiment, the third frame member includes a first side region and a second side region. The first end of the third frame member is formed on the first side region. The second end of the third frame member is formed on the second side region of the third frame member. The first side region of the third frame member is positioned at an acute angle with respect to a first section of the first side region of the first frame member. The first section of the first side region of the first frame member is disposed between the intermediate region of the first frame member and the first end of the third frame member.

In another more particular embodiment, the adjustable watercraft awning includes a fastener mechanism operative to fasten the intermediate region of the first frame member to the intermediate region of the second frame member. The first frame member is held in the raised position by the fastener mechanism while the second frame member is arranged in the first raised position. In an example, the actuator is operative to exert a force on the second frame member when the second frame member is in the first raised position and the first frame member is in the raised position. The force exerted on the second frame member is sufficient to elastically deflect the second frame member.

In an example embodiment, the actuator includes a first gear rack and a first gear. The first gear rack is disposed in the first base and is movable in a linear direction. Furthermore, the actuator includes a first biasing mechanism that displaces the first gear rack in the linear direction. The first gear is adapted to mate with the first gear rack and is also mounted in the first base, and the first gear is adapted to rotate in response to the first gear rack being displaced by the biasing mechanism. The second frame member is fixably coupled to the first gear. In the example embodiment, the biasing mechanism includes a power screw having a thread set formed thereon. The biasing mechanism also includes a complementary thread engaging feature coupled to the gear rack. The complementary thread engaging feature is adapted to slidably engage the thread set of the power screw, and the biasing mechanism is self-locking. In one example, the thread engaging feature is a power screw nut, the gear rack defines a channel adapted to receive the power screw nut, and the power screw nut is seated in the channel. The actuator includes an electric motor within the first base that drives the power screw.

Optionally, the actuator includes a second gear rack disposed in the second base. The second gear rack is movable in the linear direction. The actuator also includes a second biasing mechanism operative to displace the second gear rack in the linear direction, and the actuator includes a second gear adapted to mate with the second gear rack. The second gear is mounted in the second base and adapted to rotate in response to the second gear rack being displaced by the second biasing mechanism. The second frame member is fixably coupled to the second gear.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an adjustable watercraft awning that can be deployed in a wide range of configurations. In the following description, numerous specific details are set forth (e.g., material types, electrical switches, electrical controls, etc.) in order to provide a thorough understanding of the invention. Those skilled in the art will recognize, however, that the invention may be practiced apart from these specific details. In other instances, details of well-known marine assembly practices (e.g., mounting, wire routing, etc.) and components have been omitted, so as not to unnecessarily obscure the explanation of the present invention.

Figure 1:
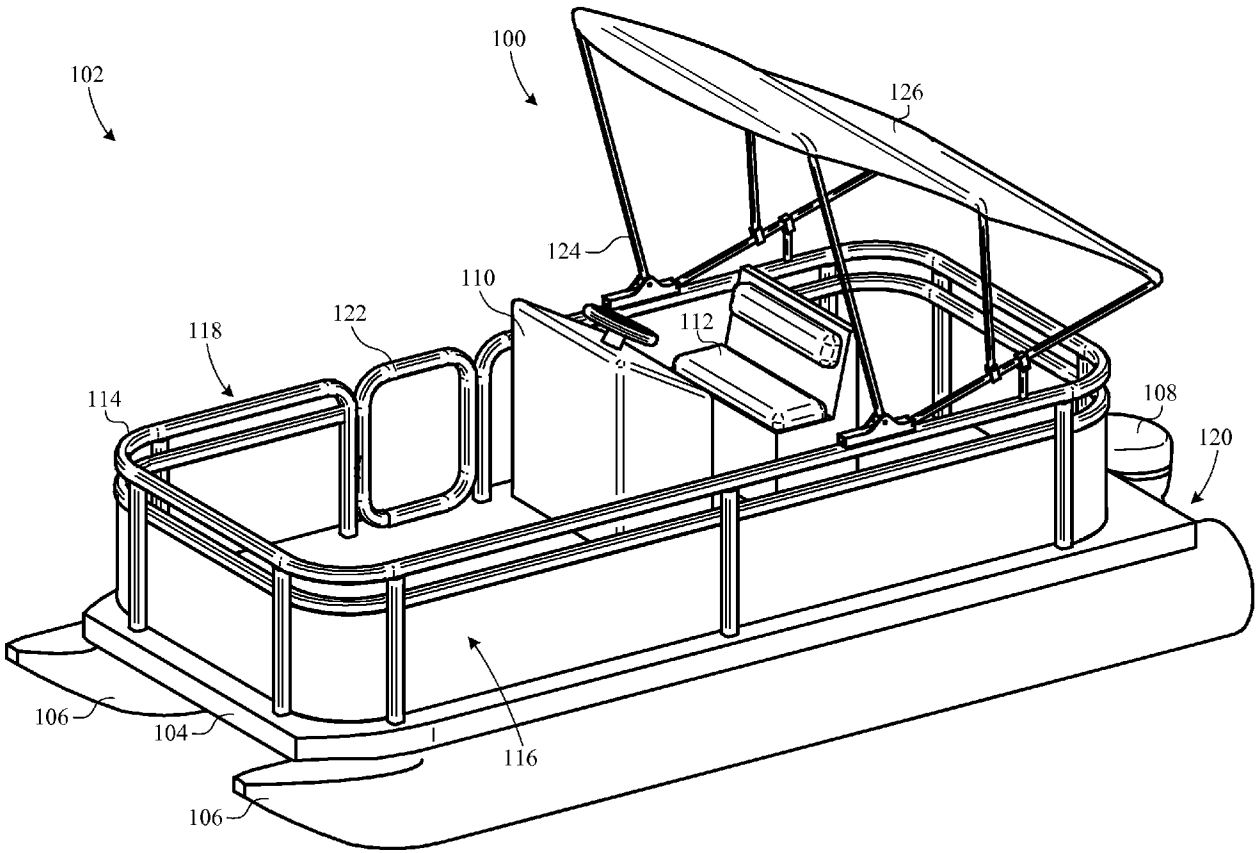
FIG. 1 is a perspective view of an adjustable watercraft awning mounted on a boat.

FIG. 1 is a perspective view of an adjustable watercraft awning 100 mounted on a watercraft 102, which is depicted by way of example as a pontoon boat. Boat 102 includes a deck 104, a set of pontoons 106, a motor 108, a console 110, a driver seat 112, and rails 114. Deck 104 provides standing area for passengers on boat 100 and is supported by pontoons 106. As shown, each of pontoons 106 is mounted on a respective one of a first side 116 and opposite, second side 118 of boat 102. Motor 108 is mounted at the rear end 120 of boat 100. Console 110 is supported on deck 104 and includes control components (e.g., steering wheel, throttle control, etc.) that facilitate the operation of boat 102. Driver seat 112 is mounted on deck 104 on second side 118 of boat 102. Rails 114 are mounted on deck 104 so as to enclose a passenger area of boat 102. As shown, rails 114 include a gate 122 located on second side 118 of boat 102. Awning 100 includes a frame 124 that supports a flexible cover 126. Frame 124 is mounted to rails 114 on first side 116 and second side 118 of boat 102. Flexible cover 126 is, for example, a canvas canopy that provides shelter over part of deck 104.

Figure 2:
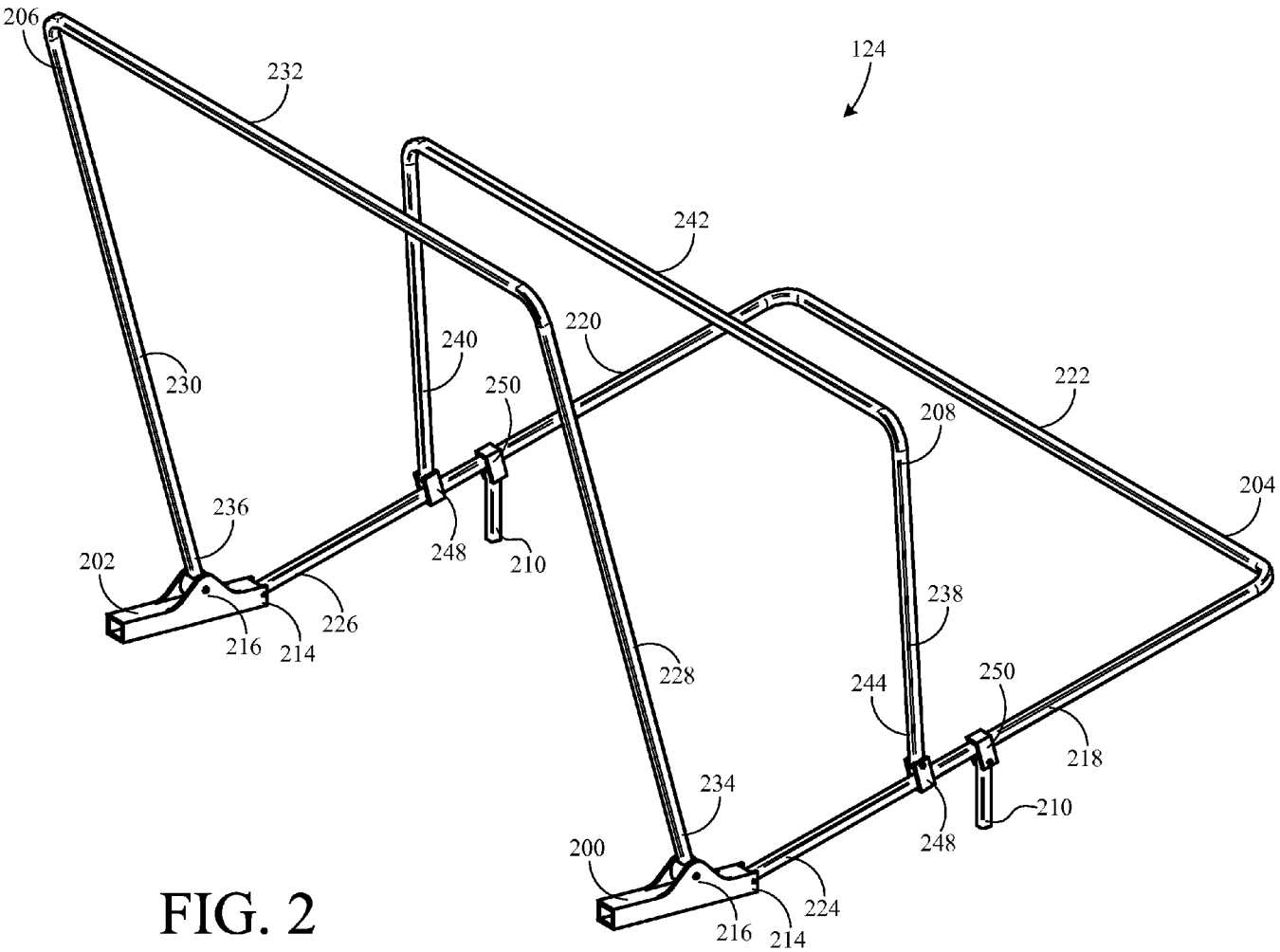
FIG. 2 is a perspective view of a frame of the watercraft awning of FIG. 1.

FIG. 2 shows a perspective view of frame 124 according to one embodiment of the present invention. Frame 124 includes a first base 200, a second base 202, a first frame member 204, a second frame member 206, a third frame member 208, a set of support legs 210, and an actuator 212 (not visible in FIG. 2, but shown in detail in FIG. 3).

First base 200 and second base 202 are adapted to mount to rails 114 on first side 116 and second side 118, respectively, of boat 102. Each of bases 200 and 202 include a rear region 214 and a front region 216.

First frame member 204 includes a first side 218, a second side 220, and an intermediate region 222. First side 218 and second side 220 include a first end 224 and a second end 226, respectively. First end 224 and second end 226 are pivotally coupled to rear regions 214 of bases 200 and 202, respectively. In the example embodiment, first end 224 and second 226 are pivotally coupled to bases 200 and 202 via hinge pins. Intermediate region 222 supports cover 126.

Second frame member 206 includes a first side 228, a second side 230, and an intermediate region 232. First side 228 and second side 230 include a first end 234 and a second end 236, respectively. First end 234 and second end 236 are pivotally coupled to front regions 216 of bases 200 and 202, respectively. Intermediate region 232 supports cover 126.

Third frame member 208 includes a first side 238, a second side 240, and an intermediate region 242. First side 238 and second side 240 define a first end 244 and a second end 246, respectively. First end 244 and second end 246 are pivotally coupled to first side 218 and second side 220 of first frame member 204, respectively, via a set of hinge brackets 248. Intermediate region 242 facilitates the support of cover 126.

Support legs 210 are fixably mounted to sides 218 and 220 of first frame member 204 via a set of brackets 250. Support legs 210 are operative to abut rails 114 of boat 100 and to support frame 126 thereon, when frame 126 is in a collapsed position.

Figure 3:
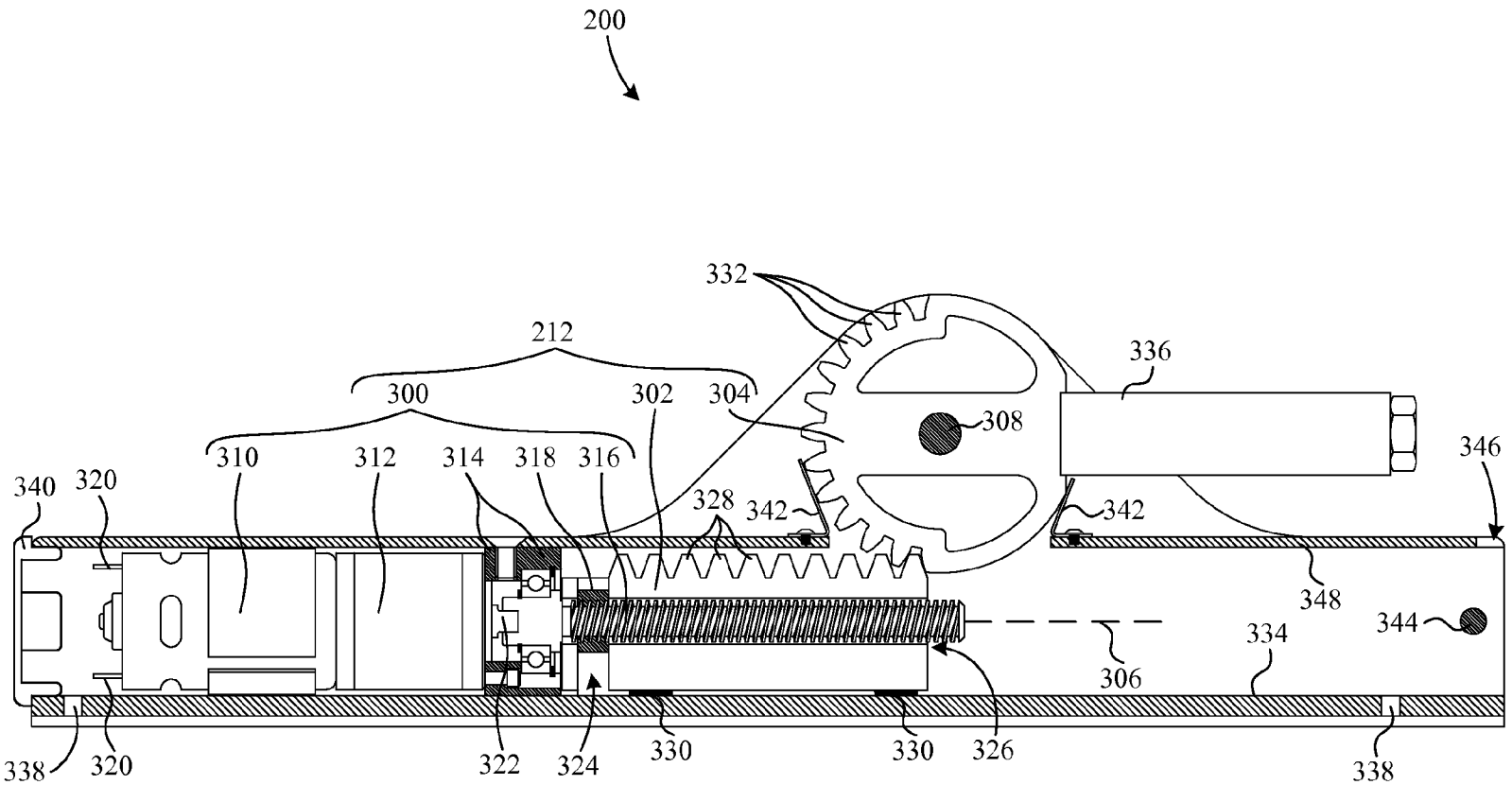
FIG. 3 is a cross-sectional side view of a base of the frame shown in FIG. 2.

FIG. 3 is a cross-sectional, side view of base 200 showing the various features and components of actuator 212. In this particular example embodiment, actuator 212 includes a biasing mechanism 300, a gear rack 302, and a gear 304. Biasing mechanism 300 is coupled to gear rack 302 and is operative to linearly displace rack 302 along an axis 306. Gear rack 302 is further coupled to gear 304 such that the linear displacement of rack 302 along axis 306 causes gear 304 to rotate about a pin 308.

Biasing mechanism 300 includes an electric motor 310, a gear box 312, bearing assembly 314, a power screw 316 (e.g., acme screw), and a power screw nut 318. Motor 310 is fixably mounted in base 200 and includes a set of electrical terminals 320 adapted to connect with a DC power source (e.g., a marine battery). Motor 310 is coupled to transfer mechanical power to gear box 312 in the form of high speed and low torque rotation. Gear box 312 converts the high-speed, low-torque power into low-speed, high-torque rotation. Furthermore, gear box 312 includes an output shaft 322 that is coupled to transfer low-speed, high-torque rotational power directly to power screw 316. Bearing assembly 314 provides horizontal support for power screw 316 and facilitates its rotation with minimal friction.

Power screw 316 and power screw nut 318, together, convert rotational motion into linear motion. In other words, the rotation of power screw 316 causes nut 318, which is coupled to gear rack 302, to move linearly along axis 306. Of course, the direction in which nut 318 and gear rack 302 are displaced depends on which direction power screw 316 is rotated. Nut 318 includes an interior that is threaded to receive screw 316 and a substantially square exterior.

Gear rack 302 defines a channel 324, a bore 326, a set of gear teeth 328, and includes a set of low-friction slide elements 330. Channel 324 is adapted to receive nut 318 such that nut 318 is loosely seated in channel 324, but cannot rotate therein. Loosely seating nut 318 in channel 324 prevents the binding of biasing mechanism 300 during operation. Bore 326 is formed completely through gear rack 302 and has a diameter sufficient to allow power screw 316 to rotate freely therein. Gear teeth 328 are adapted to mesh with a complementary set of gear teeth 332 of gear 304. Slide elements 330 are fixed to the bottom of gear rack 302 so as to minimize friction between gear rack 302 and the bottom inside surface 334 of base 200 as gear rack 302 translates back and forth along axis 306.

Gear 304 is pivotally mounted to base 200 by pin 308 and includes teeth 332 and a frame mounting feature 336. Teeth 332 are adapted to mesh with teeth 328 such that when gear rack 302 is displaced along axis 306, frame mounting feature 336 is rotated about pin 308. Frame mounting feature 336 is adapted to mount to end 234 of frame member 206 (FIG. 2).

As shown, base 200 also includes a set of mounting holes 338, an end cap 340, a set of safety guards 342, a hinge pin 344, and a cutaway 346. Mounting holes 338 facilitate the mounting of base 200 to rails 114 via threaded fasteners (e.g., screws, bolts, etc.), which are not shown. End cap 340 is, for example, a plastic cap adapted to compression fit into base 200 so as to protect and cover biasing mechanism 300. Safety guards 342 prevent unwanted objects (i.e., fingers, debris, etc.) from getting caught between gear teeth 328 and 332. Hinge pin 344 pivotally mounts end 224 of frame member 204 to base 200. Frame member 204 freely pivots within a predetermined angle about pin 344. Cutaway 346 is formed on an upper inside surface 348 of base 200 and is adapted to abut frame member 204, so as to limit the degree to which frame member 204 can be rotated.

Actuator 212 is self-locking. That is, gear 304 can only be rotated by rotating power screw 316. For example, even if torque is applied to frame mounting feature 336 without turning on motor 310, gear 304 and gear rack 302 will remain in a fixed position.

Figure 4:
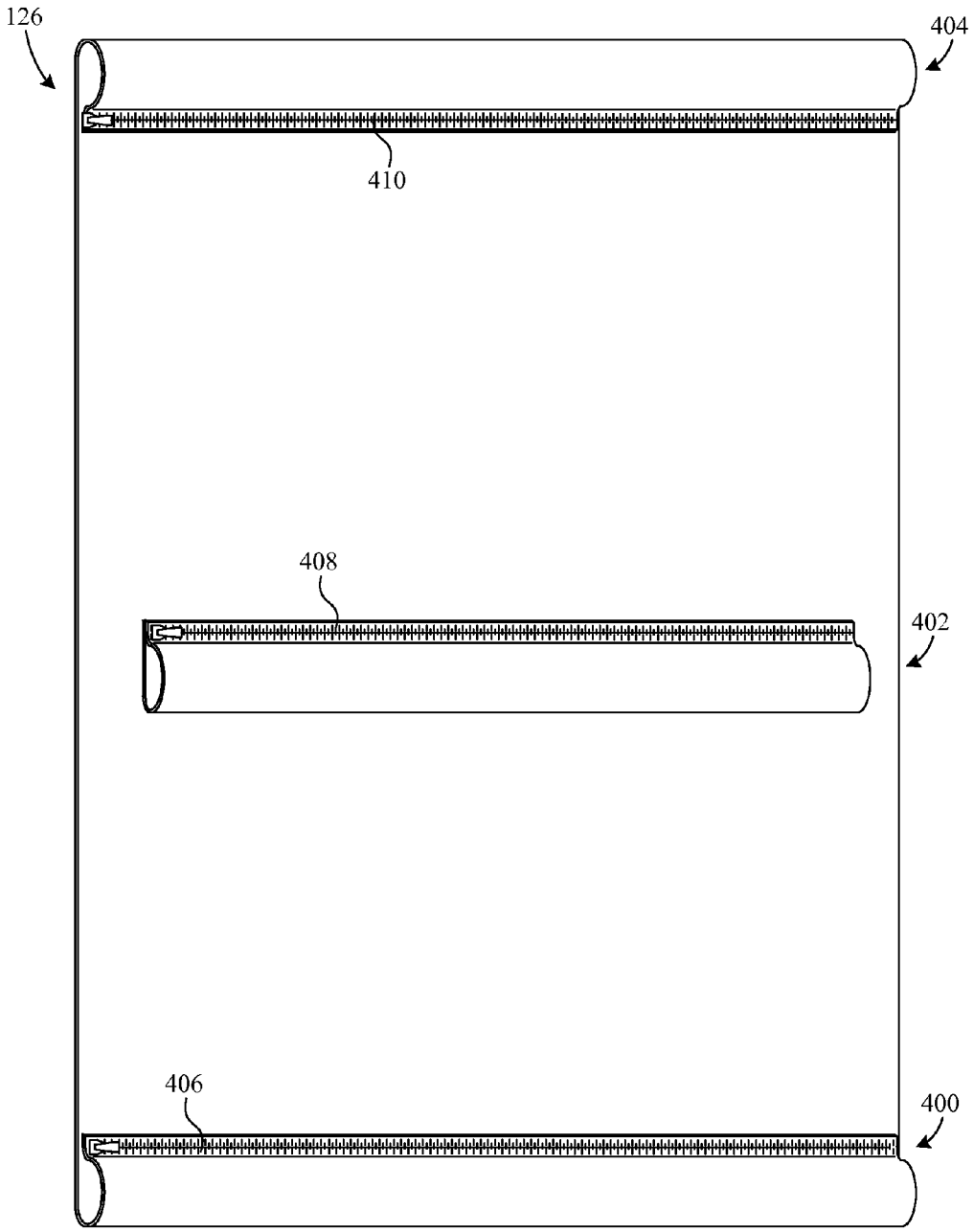
FIG. 4 is a bottom view of a flexible cover of the watercraft awning of FIG. 1.

FIG. 4 is a bottom view (underside) of flexible cover 126 removed from frame 124. In the example embodiment, cover 126 is formed from conventional canvas material commonly used in the manufacturing of boat canvases. Flexible cover 126 includes a rear region 400, an intermediate region 402, and a front region 404. Rear region 400 includes a zipper 406 that facilitates the attaching and removal of rear region 400 from intermediate region 222 of frame member 204. Intermediate region 402 includes a zipper 408 (and an extra flap of canvas) that facilitates the attaching and removal of intermediate region 402 of cover 126 from intermediate region 242 of third frame member 208. Front region 404 includes a zipper 410 that facilitates the attaching and removal of front region 404 from intermediate region 232 of second frame member 206.

Figure 5:
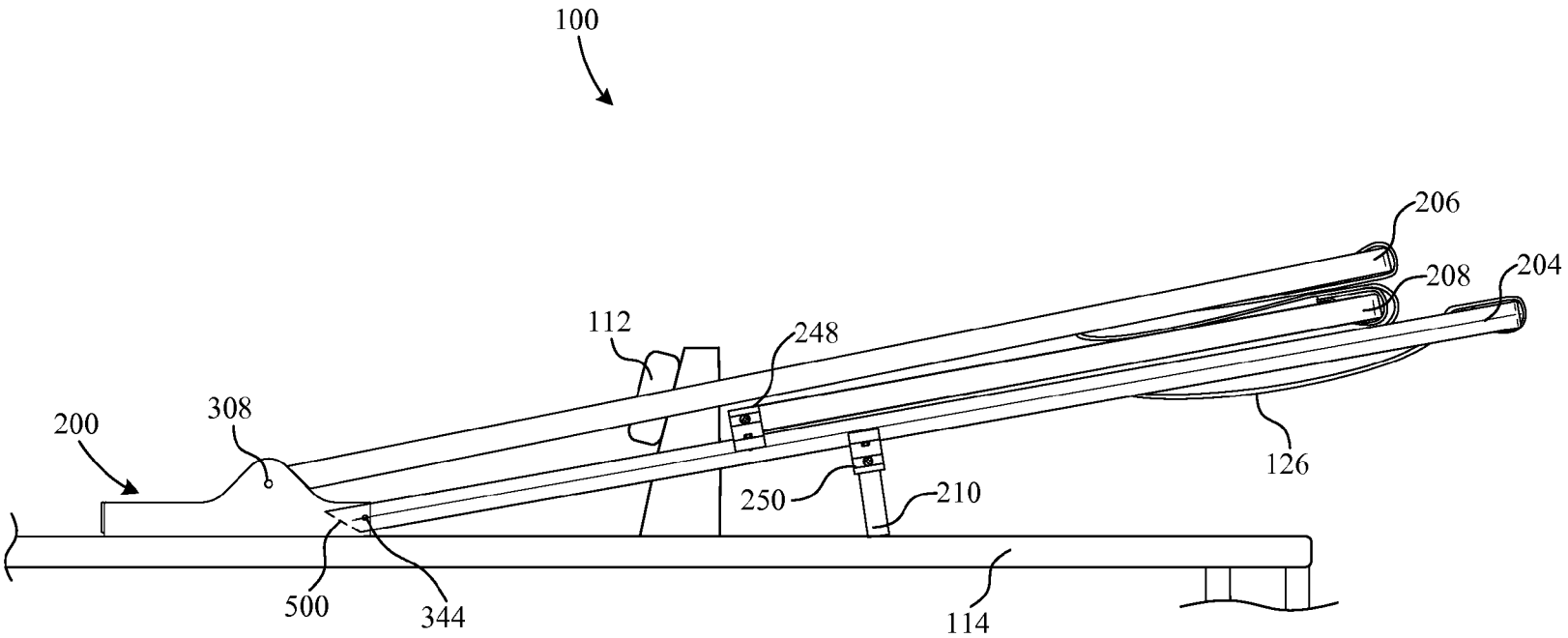
FIG. 5 is a side view of the watercraft awning of FIG. 1 in a collapsed position.

FIG. 5 is a side view of awning 100 in a collapsed position, wherein first frame member 204 is in a lowered position, second frame member 206 is in a lowered position, and third frame member 208 is in a lowered position. As shown, first frame member 204 is supported at an angle with respect to rails 114 via support legs 210. Accordingly, second frame member 206 and third frame member 208 are parallel to first frame member 204 and, therefore, also at an angle with respect to rails 114. Frame member 204 includes a rotation limiting feature 500 which, in the example embodiment, is a miter cut formed at ends 224 and 226.

Figure 6:
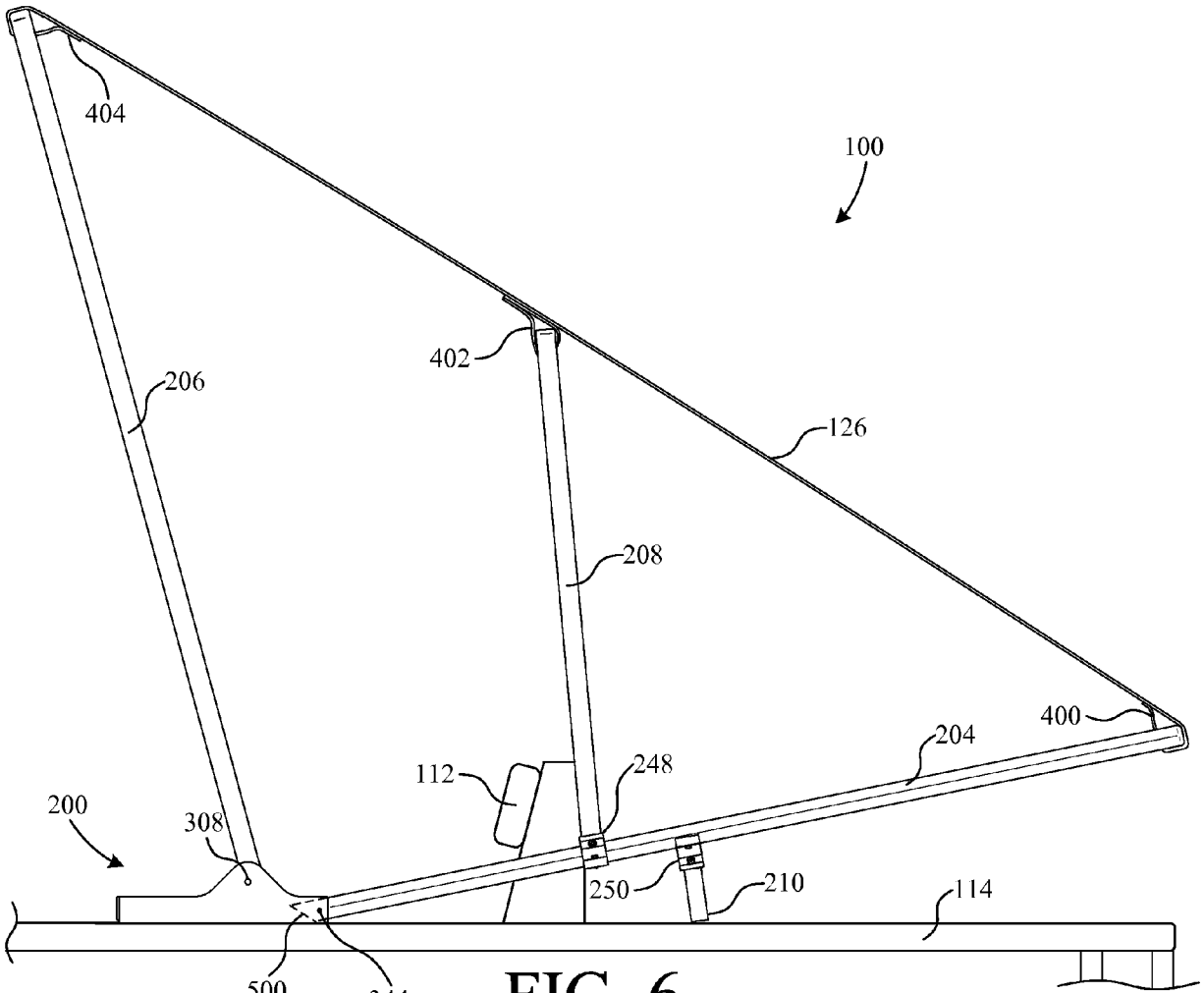
FIG. 6 is a side view of the watercraft awning of FIG. 1 in a first deployed position.

FIG. 6 is a side view of awning 100 in a first deployed position, wherein first frame member 204 is in the lowered position, second frame member 206 is in a first raised position, and third frame member 208 is in a first raised position. As shown, third frame member 208 is held in the first raised position via tension from cover 126. It should be understood that when second frame member 206 rotates back toward the lowered position, this tension is reduced thus allowing third frame 208 to also rotate back toward the lowered position. Accordingly, third frame member 208 is positioned such that in the absence of this tension, it has the tendency to return to the lowered position under the influence of gravity. It should be understood that the self-locking feature of actuator 212 enables awning 100 to maintain any semi-deployed position wherein first frame member 204 is in the lowered position, second frame member 206 is at any position between the lowered position and the first raised position, and third frame member 208 is at any position between the lowered position and the raised position. Of course, the position of third frame member 208 depends upon the position of second frame member 206.

Figure 7:
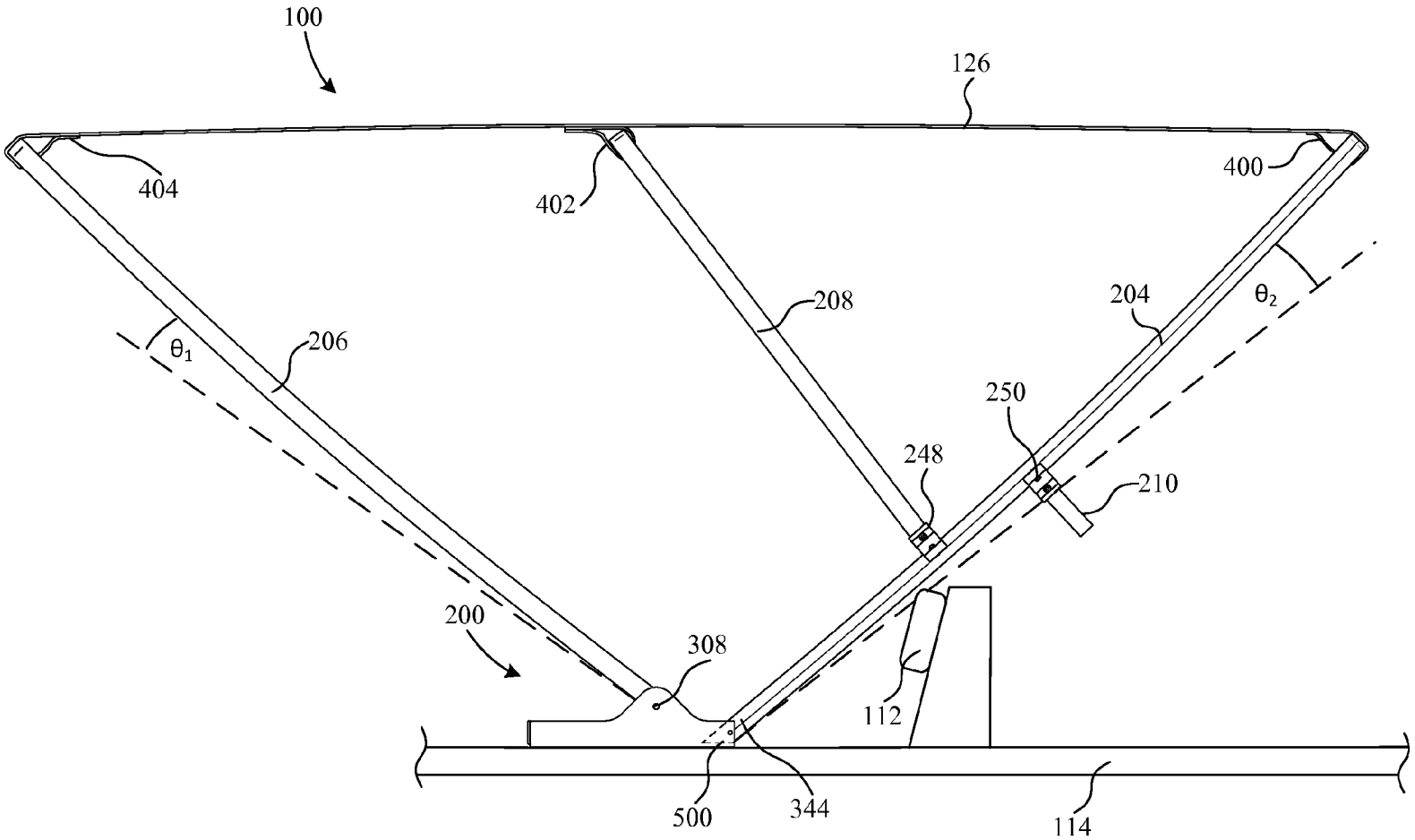
FIG. 7 is a side view of the watercraft awning of FIG. 1 in a second deployed position.

FIG. 7 is a side view of awning 100 in a second deployed position, wherein first frame member 204 is in a raised position, second frame member 206 is in a second raised position, and third frame member 208 is in the raised position.

The following example describes awning 100 during a typical deployment operation. Initially, first frame member 204 is in the lowered position, second frame member 206 is in the lowered position, and third frame member 208 is in the lowered position. Second frame member 206 begins to rotate towards the first raised position causing cover 126 to pull third frame member 208 into the raised position. First frame member 204 remains supported by legs 210 in the lowered position while second frame member is between the lowered position and the first raised position. As second frame member 206 rotates beyond the first raised position and toward the second raised position, cover 126 begins to pull first frame member 204 from the lowered position towards the raised position. First frame member 204 continues to rotate until it is stopped in the raised position via rotation limiting feature 500. That is, the mitered surface of end 224 engages bottom inside surface 334 of base 200 and the top surface of end 224 engages cutaway 346 of base 200. With first frame member 204 in the raised position and second frame member 206 in the second raised position, actuator 212 continues to rotate second frame member until first frame member 204 and second frame member 206 elastically deflect toward one another at deflection angles $\theta_1$ and $\theta_2$, respectively. It is important to understand that the stored spring force caused by the elastic deflection of frame member 204 and frame member 206 substantially increases the stability of awning 100. Once first frame member 204 and second frame member 206 are sufficiently deflected, power to actuator 212 is cutoff and the deflection is maintained, because biasing mechanism 300 is self-locking. Indeed, rotating second frame member 206 from the second raised position back to the first raised position requires driving actuator 212 in the reverse direction.

It is also important to understand that awning is not limited to a fixed number of deployed configurations. Rather, the number of deployed positions at which awning 100 can be configured is continuous between a range of positions. For example, power to actuator 212 can be cutoff when second frame member 206 is at any desired position between the first raised position and the second raised position. Of course, the position of first frame member 204 between the lowered position and the raised position will depend on the particular position of frame member 206 between the first raised position and the second raised position.

Figure 8:
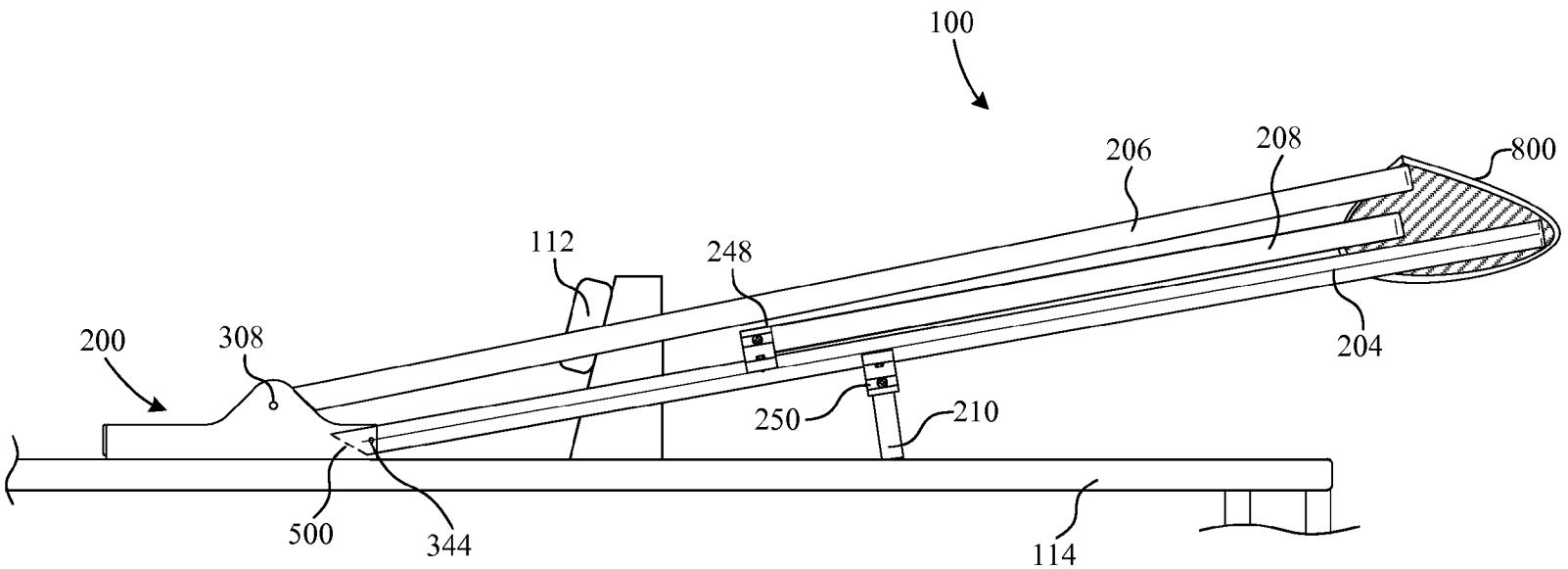
FIG. 8 shows the watercraft awning of FIG. 1 in a lowered position with a boot.

FIG. 8 shows awning 100 in a lowered position wherein first frame member 204, second frame member 206, and third frame member 208 are fastened together via a fastening device 800 which, in the example embodiment, is a conventional boot known to those skilled in the art. Boot 800 is essentially a section of material which has some suitable fastening means (e.g., zipper, snaps, hook and loop, etc.) such that it can be wrapped and fastened around cover 126, intermediate region 222 of first frame member 204, intermediate region 232 of second frame member 206, and intermediate region 242 of third frame member 208. Optionally, fastening means (e.g., straps, bands, clips, etc.) that do not fully encase cover 126 can be used instead of boot 800.

Figure 9:
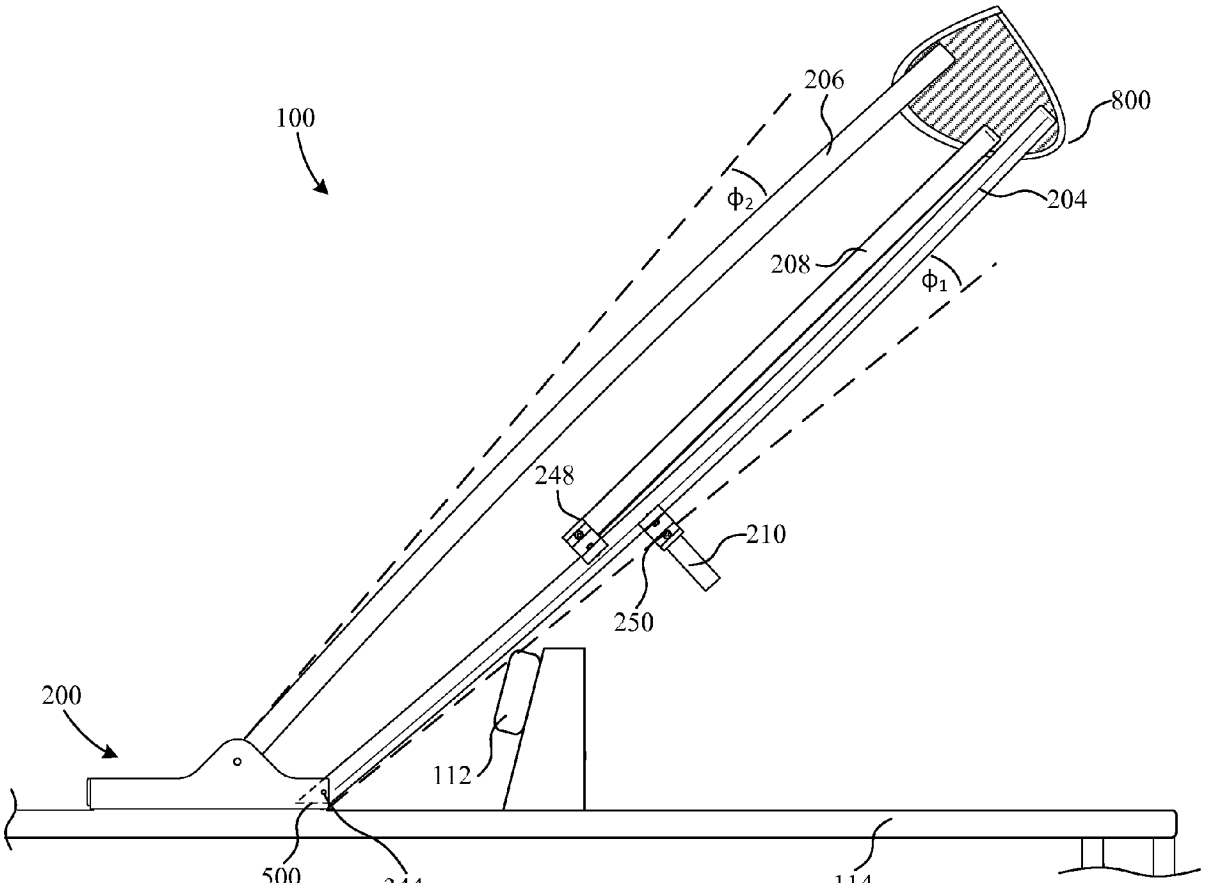
FIG. 9 shows the watercraft awning of FIG. 1 in a radar position with a boot.

FIG. 9 shows awning 100 in a radar position wherein first frame member 204, second frame member 206, and third frame member 208 are fastened to one another via boot 800.

The following example describes an example process of putting awning 100 in the radar position. Initially, first frame member 204 is in the lowered position, second frame member 206 is in the lowered position, and third frame member 208 is in the lowered position. Then, boot 800 is securely fastened around cover 126, intermediate region 222, intermediate region 232, and intermediate region 242. Power is supplied to actuator 212 causing second frame member 206 to move toward the first raised position and, because they are attached by boot 800, causing first frame member 204 to also move toward the raised position. First frame member 204 will move until it is stopped in the raised position by rotation limiting feature 500. That is, the mitered surface of end 224 engages bottom inside surface 334 of base 200, and the top surface of end 224 engages cutaway 346 of base 200. With first frame member 204 in the raised position and second frame member 206 in the first raised position, actuator 212 continues to rotate second frame member 206 until first frame member 204 and second frame member 206 elastically deflect toward one another at deflection angles $\phi_1$ and $\phi_2$, respectively. The stored spring force caused by the elastic deflection of first frame member 204 and second frame member 206 substantially increases the stability of awning 100. Once first frame member 204 and second frame member 206 are sufficiently deflected, power to actuator 212 is cutoff and the deflection is maintained because biasing mechanism 300 is self-locking. Indeed, rotating second frame member 206 from the first raised position back to the lowered position requires driving actuator 212 in the reverse direction.

Figure 10:
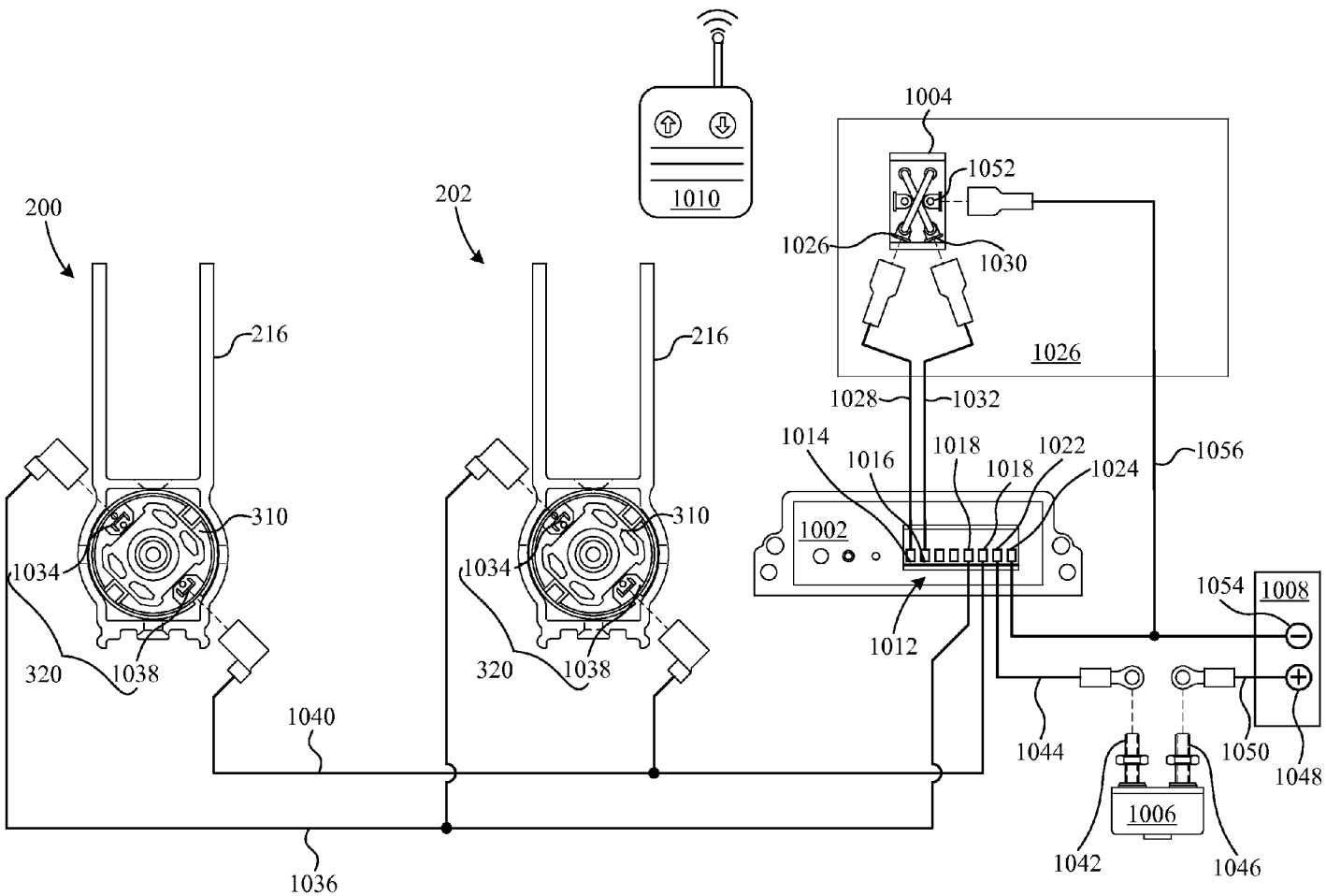
FIG. 10 shows an example drive circuit of the watercraft awning of FIG. 1.

FIG. 10 shows a schematic of a driving circuit 1000 of awning 100 according to one embodiment of the present invention. Circuit 1000 includes a radio frequency (RF) control module 1002, a reversing toggle switch 1004, a short stop breaker 1006, motor 310 of base 200, motor 310 of base 202, and a battery 1008 of boat 102.

RF module 1002 is adapted to receive wireless signals from a user controlled finger-operated button (FOB) 1010, such that the user can control the actuation of awning 100 remotely. RF module 1002 includes a plurality of terminals 1012 electrically connected to reversing toggle switch 1004, short stop breaker 1006, motor 310 of base 200, motor 310 of base 202, and battery 1008. Terminals 1012 include a first terminal 1014, a second terminal 1016, a third terminal 1018, a fourth terminal 1020, a fifth terminal 1022, and a sixth terminal 1024. First terminal 1014 of module 1002 is electrically connected to a first terminal 1026 of reversing toggle switch 1004 via a wire 1028. Second terminal 1016 of module 1002 is electrically connected to a second terminal 1030 of reversing toggle switch 1004 via a wire 1032. Third terminal 1018 of module 1002 is electrically connected to a first terminals 1034 of terminals 320 of motors 310 via a wire 1036. Likewise, fourth terminal 1020 of module 1002 is electrically connected to a second terminal 1038 of terminals 320 of motors 310 via a wire 1040. Accordingly, motor 310 of base 200 is wired in parallel to motor 310 of base 202. Fifth terminal 1022 of module 1002 is electrically connected to a first terminal 1042 of breaker 1006 via a wire 1044. Breaker 1006 also includes a second terminal 1046 that is electrically connected to a positive terminal 1048 of battery 1008 via a wire 1050. Sixth terminal of module 1002 is electrically connected to a third terminal 1052 of switch 1004 and a negative terminal 1054 of battery 1008 via a wire 1056.

Reverse toggle switch 1004 is located at a helm switch control 1026 of console 110 so as to facilitate local control of awning 100. Reverse toggle switch 1004 is, for example, a three-position switch that operates in a forward position, a middle position, and a back position. When switch 1004 is in the forward position, module 1002 actuates motors 310 in the forward direction. When switch 1004 is in the middle position, module 1002 does not assert a voltage across motors 310. When switch 1004 is in the back position, module 1002 actuates motors 310 in the reverse direction via a reverse polarity voltage.

Short stop breaker 1006 provides a means for stopping motors 310 when one or both rotors of motors 310 are locked.

When a motor's rotor is "locked", the motor draws substantially more current. When this current reaches the predetermined current rating of breaker 1006, the power supplied to motors 310 is interrupted. In this manner, breaker 1006 cuts off the power to motors 310 when frame members 204 and 206 are sufficiently deflected as shown in FIG. 7 and FIG. 9. Indeed, breaker 1006 allows current to flow as frame member 206 is driven between positions. However, when motors 310 are driven after rotation limiting feature 500 has engaged surface 334, frame members 204 and 206 become increasingly more deflected. The deflection continues to increase until finally the rotors of motors 310 become locked, and the locked-rotor current is sufficient to trip breaker 1006, thus shutting down motors 310. As previously mentioned, the self-locking feature of biasing mechanism 300 ensures frame members 204 and 206 remain in this deflected state when motors 310 are off. Not only does breaker 1006 provide a means for shutting down motors 310 when frame members 204 and 206 are sufficiently deflected, but also when awning 100 is properly lowered. For example, as motors 310 are reversed to lower frame member 206, the current drawn by motors 310 remains under the rated current of breaker 1006. Once frame member 206 cannot be lowered any further, the rotors of motors 310 become locked causing the current draw to increase, thus tripping breaker 1006. Yet another function of breaker 1006 is that it shuts off motors 310 when awning 100 encounters an obstruction. For example, if an individual's body is between frame member 204 and 206 when frame member 206 is being lowered, the obstruction will cause a locked rotor scenario that trips breaker 1006.

Breaker 1006 also serves to align the left and right sides of awning 100 each time awning 100 is fully raised or lowered. In particular, breaker 1006 opens in response to the combined current drawn by both motors 310 when their rotors are locked. If the rotor of only one motor 310 is locked (a first side of awning 100 is in the fully raised or lowered position), power will continue to be provided until the second, opposite side of awning 100 is also in the fully raised or lowered position. Then, the rotor on the second, opposite side of awning 100 also becomes locked, and the combined current from both motors opens breaker 1006.

Figure 11:
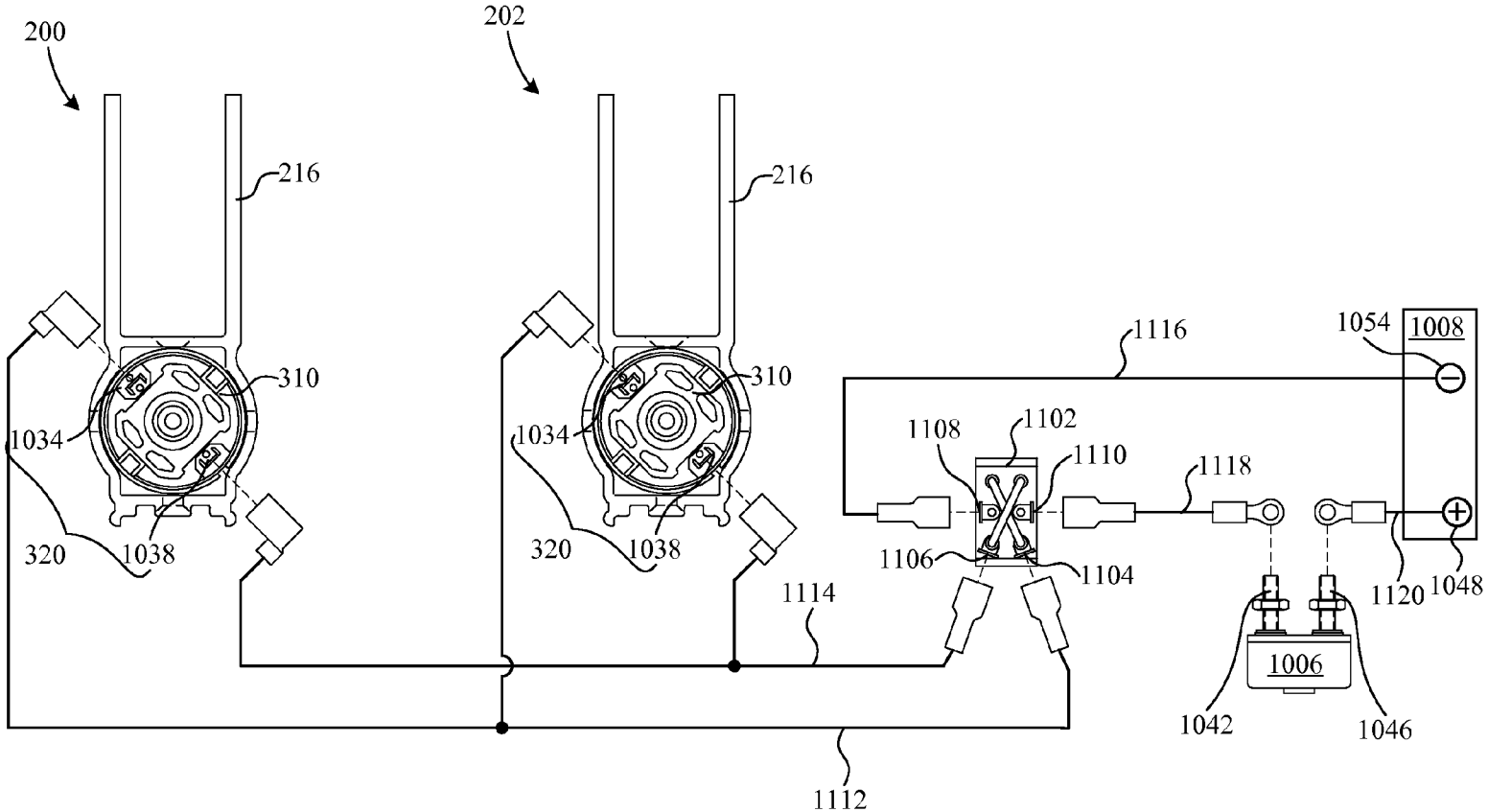
FIG. 11 shows another example drive circuit of the watercraft awning of FIG. 1.

FIG. 11 shows a schematic of a circuit 1100 of awning 100 according to an alternate embodiment of the present invention. Circuit 1100 includes a reversing toggle switch 1102, breaker 1006, motor 310 of base 200, motor 310 of base 202, and battery 1008 of boat 102.

Reversing toggle switch 1102 includes a first terminal 1104, a second terminal 1106, a third terminal 1108, and a fourth terminal 1110. First terminal 1104 of switch 1102 is electrically connected to first terminals 1034 of terminals 320 of motors 310 via a wire 1112. Likewise, second terminal 1106 of switch 1102 is electrically connected to second terminal 1038 of terminals 320 of motors 310 via a wire 1114. Accordingly, motor 310 of base 200 is wired in parallel to motor 310 of base 202. Third terminal 1108 of switch 1102 is electrically connected to negative terminal 1054 of battery 1008 via a wire 1116. Fourth terminal 1110 of switch 1102 is electrically connected to first terminal 1042 of breaker 1006 via a wire 1118. Second terminal 1046 of breaker 1006 is electrically connected to positive terminal 1048 of battery 1008 via a wire 1120. Reversing toggle switch 1102 is, for example, a three-position switch that operates in a forward position, a middle position, and a back position. When switch 1102 is in the forward position, forward polarity voltage from battery 1008 is supplied to motors 310 thus frame member 206 toward the raised position. When switch 1102 is in the middle position, it open thus not supplying motors 310 with power. When switch 1102 is in the back position, reverse polarity voltage from battery 1008 is supplied to motors 310 thus driving frame member 206 toward the lowered position. Note that the functionality of breaker 1006 is identical for both circuit 1000 and circuit 1100. Accordingly, the description of breaker 1006 with reference to circuit 1100 is withheld so as to avoid redundancy.

The description of particular embodiments of the present invention is now complete. Many of the described features may be substituted, altered or omitted without departing from the scope of the invention. For example, alternate mechanical drive systems (e.g., manual power screw), may be substituted for motors 310. As another example, cover 126 could be fabricated from any type of material that produces some desirable sheltering effect such as mesh that only partially blocks sunlight. As yet another example, the bases that pivotally support the frame members could each be formed from two or more separate pieces that are mounted spaced apart from one another. In addition, it is not necessary for both frame members to be coupled to the bases. For example, one frame member can be pivotally connected to a portion of the other frame member. As yet another example, one or more alternate coupling members (e.g., straps, cords, slotted bars, etc.) can be used to couple the frame members to transfer movement from the second frame member to the first frame member. As another example, alternate features (e.g., stop pins, tracks, straps, anchors, etc.) can be used to limit the movement of the first frame member. In addition, although the present invention is described by way of example with reference to a watercraft awning, it should be understood that the invention can also be used in combination with other vehicles (e.g., golf carts, etc.) and/or structures (e.g., decks, hot tubs, etc.). These and other deviations from the particular embodiments shown will be apparent to those skilled in the art, particularly in view of the foregoing disclosure.

We claim:

1. An adjustable watercraft awning, comprising:

a first base adapted to mount on a first side of a watercraft;

a second base adapted to mount on a second side of said watercraft opposite said first side of said watercraft;

a first frame member having a first end, a second end, and an intermediate region, said first frame member being movable between a lowered position and a raised position;

a second frame member having a first end, a second end, and an intermediate region, said first end of said second frame member being pivotally coupled to said first base, said second end of said second frame member being pivotally coupled to said second base, said second frame member being movable between a lowered position and a first raised position, said second frame member being further movable between said first raised position and a second raised position;

an actuator coupled to transmit mechanical power to said second frame member; and a coupling member coupled to pull said first frame member from said lowered position to said raised position when said second frame member is moved from said first raised position to said second raised position by said actuator.

2. The adjustable watercraft awning of claim 1, wherein:

said first base includes a rear region and a front region;

said second base includes a rear region and a front region;

said first end of said first frame member is pivotally coupled to said rear region of said first base and said second end of said first frame member is pivotally coupled to said rear region of said second base; and said first end of said second frame member is pivotally coupled to said front region of said first base and said second end of said second frame member is pivotally coupled to said front region of said second base.

3. The adjustable watercraft awning of claim 2, wherein at least one of said first base and said second base includes two physically separate portions, said front region being disposed on one of said physically separate portions and said rear region being disposed on the other of said physically separate portions.

4. The adjustable watercraft awning of claim 2, wherein at least one of said first base and said second base includes a unitary structure, said front region being disposed on one part of said unitary structure and said rear region being disposed on another part of said unitary structure.

5. The adjustable watercraft awning of claim 1, wherein said coupling member is a flexible cover having a rear region and a front region, said rear region of said flexible cover being coupled to said intermediate region of said first frame member, said front region of said flexible cover being coupled to said intermediate region of said second frame member, said flexible cover being operative to unfold to a deployed position in response to moving said second frame member from said lowered position to said first raised position.

6. The adjustable watercraft awning of claim 1, further comprising a rotation limiting feature operative to prevent said first frame member from rotating beyond said raised position.

7. The adjustable watercraft awning of claim 6, wherein said rotation limiting feature includes a first mitered surface formed on said first end of said first frame member and a second mitered surface formed on said second end of said first frame member, said first mitered surface being adapted to abut said first base when said first frame member is in said raised position, said second mitered surface being adapted to abut said second base when said first frame member is in said raised position.

8. The adjustable watercraft awning of claim 6, wherein said actuator is operative to exert a force on said second frame member when said second frame member is in said second raised position and said first frame member is in said raised position, said force sufficient to elastically deflect said second frame member.

9. The adjustable watercraft awning of claim 1, wherein:

said first frame member defines a first side region and an opposite second side region, said first end of said first frame member being formed on said first side region of said first frame member, said second end of said first frame member being formed on said second side region of said first frame member;

said adjustable watercraft awning further includes a third frame member having a first end, a second end, and an intermediate region;

said first end of said third frame member is pivotally coupled to said first side region of said first frame member between said first end of said first frame member and said intermediate region of said first frame member;

said second end of said third frame member is pivotally coupled to said second side region of said first frame member between said second end of said first frame member and said intermediate region of said first frame member; and said intermediate region of said third frame member is couple to said intermediate region of said coupling member.

10. The adjustable watercraft awning of claim 9, wherein said third frame member is disposed to move toward said intermediate region of said first frame member as said second frame member is moved from said first raised position of said second frame member to said down position of said second frame member.

11. The adjustable watercraft awning of claim 10, wherein said third frame member includes a first side region and a second side region, said first end of said third frame member being formed on said first side region of said third frame member, said second end of said third frame member being formed on said second side region of said third frame member, said first side region of said third frame member being positioned at an acute angle with respect to a first section of said first side region of said first frame member, said first section of said first side region of said first frame member being disposed between said intermediate region of said first frame member and said first end of said third frame member.

12. The adjustable watercraft awning of claim 1, further comprising a fastener mechanism operative to fasten said intermediate region of said first frame member to said intermediate region of said second frame member, said first frame member being held in said raised position at least partially by said fastener mechanism when said second frame member is disposed in said first raised position.

13. The adjustable watercraft awning of claim 12, wherein said actuator is operative to exert a force on said second frame member when said second frame member is in said second raised position and said first frame member is in said raised position, said force being sufficient to elastically deflect said second frame member.

14. The adjustable watercraft awning of claim 1, wherein:

said actuator includes a first gear rack disposed in said first base, said first gear rack being movable in a linear direction;

said actuator includes a first biasing mechanism operative displace said first gear rack in said linear direction;

said actuator includes a first gear adapted to mate with said first gear rack, said first gear being mounted in said first base, said first gear being adapted to rotate in response to said first gear rack being displaced by said biasing mechanism; and said second frame member is fixably coupled to said first gear.

15. The adjustable watercraft awning of claim 14, wherein:

said biasing mechanism includes a power screw having a thread set formed thereon;

said biasing mechanism includes a complementary thread engaging feature coupled to said gear rack, said complementary thread engaging feature being adapted to slidably engage said thread set of said power screw; and said biasing mechanism is self-locking.

16. The adjustable watercraft awning of claim 15, wherein:

said thread engaging feature is a power screw nut;

said gear rack defines a channel adapted to receive said power screw nut; and said power screw nut is seated in said channel.

17. The adjustable watercraft awning of claim 15, wherein said actuator includes an electric motor operative to drive said power screw and said electric motor is disposed within said first base.

18. The adjustable watercraft awning of claim 17, wherein:

said actuator includes a second gear rack disposed in said second base, said second gear rack being movable in said linear direction;

said actuator includes a second biasing mechanism operative displace said second gear rack in said linear direction;

said actuator includes a second gear adapted to mate with said second gear rack, said second gear being mounted in said second base, said second gear being adapted to rotate in response to said second gear rack being displaced by said second biasing mechanism; and said second frame member is fixably coupled to said second gear.

19. The adjustable watercraft awning of claim 1, wherein:

said actuator includes a first gear rack disposed in said first base, said first gear rack being movable in a linear direction;

said actuator includes a power screw operative displace said first gear rack in said linear direction, said power screw being mounted in said first base;

said actuator includes an electric motor mounted in said first baser, said electric motor being operative to drive said power screw;

said actuator includes a first gear adapted to mate with said first gear rack, said first gear being mounted in said first base, said first gear being adapted to rotate in response to said first gear rack being displaced by said power screw;

said second frame member is fixably coupled to said first gear;

said awning further includes a rotation limiting feature operative to prevent said first frame member from rotating beyond said raised position;

said actuator is operative to exert force on said second frame member when said second frame member is in said second raised position and said first frame member is in said raised position, said second frame member being responsive to deflect elastically when subjected to force;

said awning further includes a fastener mechanism operative to fasten said intermediate region of said first frame member to said intermediate region of said second frame member, said first frame member being held in said raised position by said fastener mechanism while said second frame member is arranged in said first raised position; and said actuator is operative to exert force on said second frame member when said second frame member is in said first raised position and said first frame member is fastened to said second frame member such that said first frame member is held in said raised position, said second frame member being responsive to deflect elastically when subjected to force.

20. A watercraft having an adjustable awning, said adjustable awning comprising:

a first base adapted to mount on a first side of a watercraft, said base having a rear region and a front region;

a second base adapted to mount on a second side of said watercraft opposite said first side of said watercraft, said base having a rear region and a front region;

a first frame member having a first end, a second end, and an intermediate region, said first end being pivotally coupled to said rear region of said first base, said second end being pivotally coupled to said rear region of said second base, said first frame member being adapted to pivot between a lowered position and a raised position;

a second frame member having a first end, a second end, and an intermediate region, said first end of said second frame member being pivotally coupled to said front region of said first base, said second end of said second frame member being pivotally coupled to said front region of said second base, said second frame member being adapted to pivot between a lowered position and a first raised position, said second frame member being further adapted to pivot between said first raised position and a second raised position;

a mechanical drive mechanism coupled to transmit mechanical power to said second frame member; and a flexible cover having a rear region and a front region, said rear region being coupled to said intermediate region of said first frame member, said front region of said flexible cover being coupled to said intermediate region of said second frame member, said flexible cover being operative to unfold to a deployed position in response to moving said second frame member from said lowered position to said first raised position, said flexible cover being further operative to pull said first frame member from said lowered position to said raised position in response to moving said second frame member from said first raised position to said second raised position.

* * * * *